US006225760B1

(12) United States Patent
Moan

(10) Patent No.: US 6,225,760 B1
(45) Date of Patent: May 1, 2001

(54) FLUORESCENT LAMP DIMMER SYSTEM

(75) Inventor: James M. Moan, Center Valley, PA (US)

(73) Assignee: Lutron Electronics Company, Inc., Coopersburg, PA (US)

( * ) Notice: Subject to any disclaimer, the term of this patent is extended or adjusted under 35 U.S.C. 154(b) by 0 days.

(21) Appl. No.: 09/123,722

(22) Filed: Jul. 28, 1998

(51) Int. Cl.[7] ..... H05B 37/02

(52) U.S. Cl. ..... 315/360; 315/209 R; 315/219; 315/362

(58) Field of Search ..... 315/219, 291, 315/209 R, 360, 362

(56) References Cited

U.S. PATENT DOCUMENTS 2,978,286 4/1961 Nick .
3,682,525 8/1972 Knochel et al. .
5,357,170 10/1994 Luchaco .
5,550,438 * 8/1996 Reijnaerts ..... 315/219

FOREIGN PATENT DOCUMENTS 4314993 11/1994 (DE) .
0677981 10/1995 (EP) .
2136226 9/1984 (GB) .
9002475 3/1990 (WO) .

* cited by examiner

*Primary Examiner*—David Vu
(74) *Attorney, Agent, or Firm*—Ostrolenk, Faber, Gerb & Soffen, LLP

(57) ABSTRACT

A fluorescent lamp controller with dimming capability has its dimming function disabled for a given period of time, preferably about 100 hours, when new lamps are connected to a ballast to "season" the lamps by driving them at full rated current. The dimming function is restored after the seasoning interval has passed. An indicator is provided to inform the user that the seasoning function is in use.

33 Claims, 9 Drawing Sheets

FLUORESCENT LAMP DIMMER SYSTEM

CROSS REFERENCE TO RELATED APPLICATION

This application is related to application Ser. No. 09/123,727 filed concurrently herewith and entitled "FLUORESCENT LAMP DIMMER SYSTEM FOR MAINTAINING ILLUMINATION LEVEL ON A WORK SURFACE". The disclosure of said application is hereby incorporated by reference.

BACKGROUND OF THE INVENTION

This invention relates to fluorescent lamp dimming systems and more specifically relates to a novel system to insure seasoning, or burn-in of new (unused) fluorescent lamps before a dimming function can be enabled.

Fluorescent lamp dimming systems are well known. A typical system of this kind is shown and described in U.S. Pat. No. 5,357,170 in the names of Luchaco and Yorgey, issued Oct. 18, 1994 and assigned to the assignee of the present invention and is herein incorporated by reference. Such systems include a dimming ballast which may be mounted nearby to the lamps and which may be conventionally controlled by the output of a conventional programmable lamp controller such as a controller of the type designated as a microWATT controller, a registered trade mark of the assignee of the present invention. The input control to the controller can be derived from any type of device, such as a manually settable dimmer control, an ambient light sensor, an occupancy sensor, a time clock, and security and safety systems, to name a few. The output of the controller to the ballast serves to control the light output of the lamps connected to the dimming ballast.

It is known that some new (previously unused) fluorescent lamps will fail prematurely (in as short as a few days) unless the lamps are burned in or seasoned in a system subjected to dimming. It is also known that fluorescent lamps should be "seasoned" or "burned-in" (these terms are used interchangeably) by operating them for a given length of time, for example, 100 hours, at some given power, usually at full rated current, before the lamps are dimmed. This seasoning operation will condition the lamps and allow them to be dimmed without suffering premature failure after the process is completed. In a more restricted burn-in technique, the lamps are operated without turning off for 100 hours at full rated current.

Many reasons have been offered for the need for this seasoning or burn-in requirement, but it is not yet fully understood, nor is any specific minimum seasoning time or operating power known to insure seasoning of all lamps. However, it is believed that seasoning for about 100 hours at full rated lamp current should season all lamps, although shorter times or new sequences which may use reduced current may be developed and used at some time in the future, but still using the burn-in concepts of this invention as it relates to a dimmer control system.

The technical reasons for the need for burn-in or seasoning are better understood from an analysis of the typical fluorescent lamp. A fluorescent lamp consists of a glass tube which is internally coated with a phosphor; a gas fill typically consisting of mercury and an inert gas such as argon or krypton; and of electrodes which act as the source of, and collection point for, electrons that make up the majority of the "arc" current in the lamp. All three elements of the lamp play an important role in defining the quality of the lamp in operation. All three elements are also subject to lamp-to-lamp and lot-to-lot variations in the manufacturing process.

The manufacturing process begins with the cleaning of the glass and coating it with phosphor. The phosphor is then thermally cured to the glass. The electrode assembly—consisting of filaments attached to support wires and coated with (electron) emissive material (usually barium carbonate), a glass bead for structural integrity, and a glass end cap with an evacuation tube—is then fused to the glass tube. The entire assembly is heated to a high temperature at which the barium carbonate dissociates into barium oxide and carbon dioxide. The carbon dioxide is pumped out of the lamp together with its air fill when the lamp is evacuated. After that, mercury is introduced into the lamp, typically in the form of a drop or pellet, and an inert gas fill is applied to the lamp. Finally, the lamp is sealed from the outside environment, tested, and shipped.

Manufacturing variations exist in all the processes described above. Thus, different amounts of emissive coating are applied to different filaments, there may be lot-to-lot variations in heating profiles and temperatures, as well as fill gas pressures and efficiencies in evacuating the lamp. The end result is that some variation exists between lamps with regard to their impurity content, such as carbon dioxide and water. More importantly, the amount of impurities is typically not measured or monitored in the manufacturing process, so that it is not possible to tell by looking at manufacturing data whether a particular lamp has a high or low quantity of impurities, or of what kind.

The role of the impurities, even in trace quantities, can be detrimental. First, they can cause lamps to exhibit undue flickering or striations when they are dimmed. Furthermore, in extreme cases they can coat the filament and its emissive coating with material, such as carbon, which inhibits the ability of the electrode to function as an electron source for the discharge ("arc"). In this condition, the electrode quickly fails due to excessive ion bombardment from the discharge, and the lamp can fail in a matter of days.

The role of the burn-in is to operate the lamp at some current, preferably at its full rated current for an extended period of time without interruption. This operating mode sets up the "design condition" for the electrode, and develops a proper hot spot in the filament to support the arc current. Past experience has shown that this operating mode is particularly good at "transporting" the impurity materials to the phosphor coating, where they become absorbed in the phosphor structure and never again re-enter the discharge, rather than letting them coat the filament with impurity matter. While this process does not cure the worst possible lamps, it takes care of the majority of problematic impurity issues in most lamps. It is of course possible to find a lamp manufactured in ideal conditions and with an ideal process that does not contain significant impurities, and can be operated, without harm, in dimming conditions straight out of the box but it is not possible at the present time to identify those lamps in a new batch.

For the above reasons, all fluorescent lamps should be "burned-in" at full light output for a period of 100 hours (which is a fairly safe time) before using them in a dimming mode. This will minimize problems with short lamp life.

However, it would be inefficient and unduly expensive to burn-in all fluorescent lamps made by a particular manufacturer since most are intended for use in a non-dimming application and do not require seasoning or burn-in.

SUMMARY OF THE INVENTION

In accordance with the invention, a novel lighting control system with dimming capability has an added control which disables the dimming capability of the system for a predetermined length of time following a disable command and ensures the energization of the lamps at some predetermined power for that predetermined time. Preferably the lamps are operated at full rated current for about 100 hours without interruption. The new function is easily added to existing control systems by the use of a count-down timer which has its timing initiated by the manual operation of a switch to disable the dim-control signals for the time interval. Preferably, an indicator, such as a lamp, or flashing light emitting diode, is also turned on during the burn-in period to inform the user that dimming has been intentionally disabled.

DETAILED DESCRIPTION OF THE DRAWING

Figure 1:
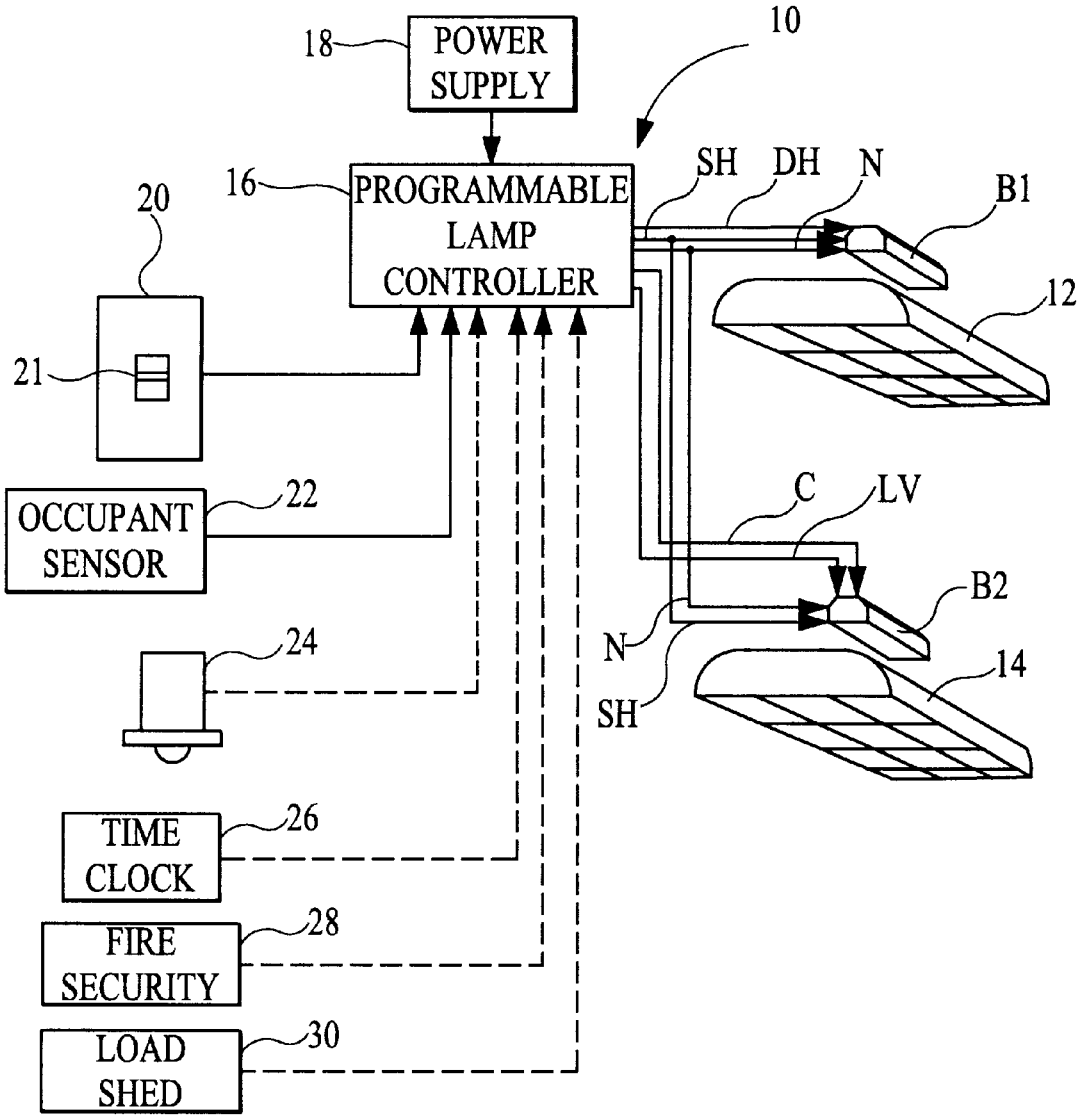
FIG. 1 (PRIOR ART)
FIG. 1 is a schematic illustration of a known lighting control system which can be modified to incorporate the present invention.
Figure 2:
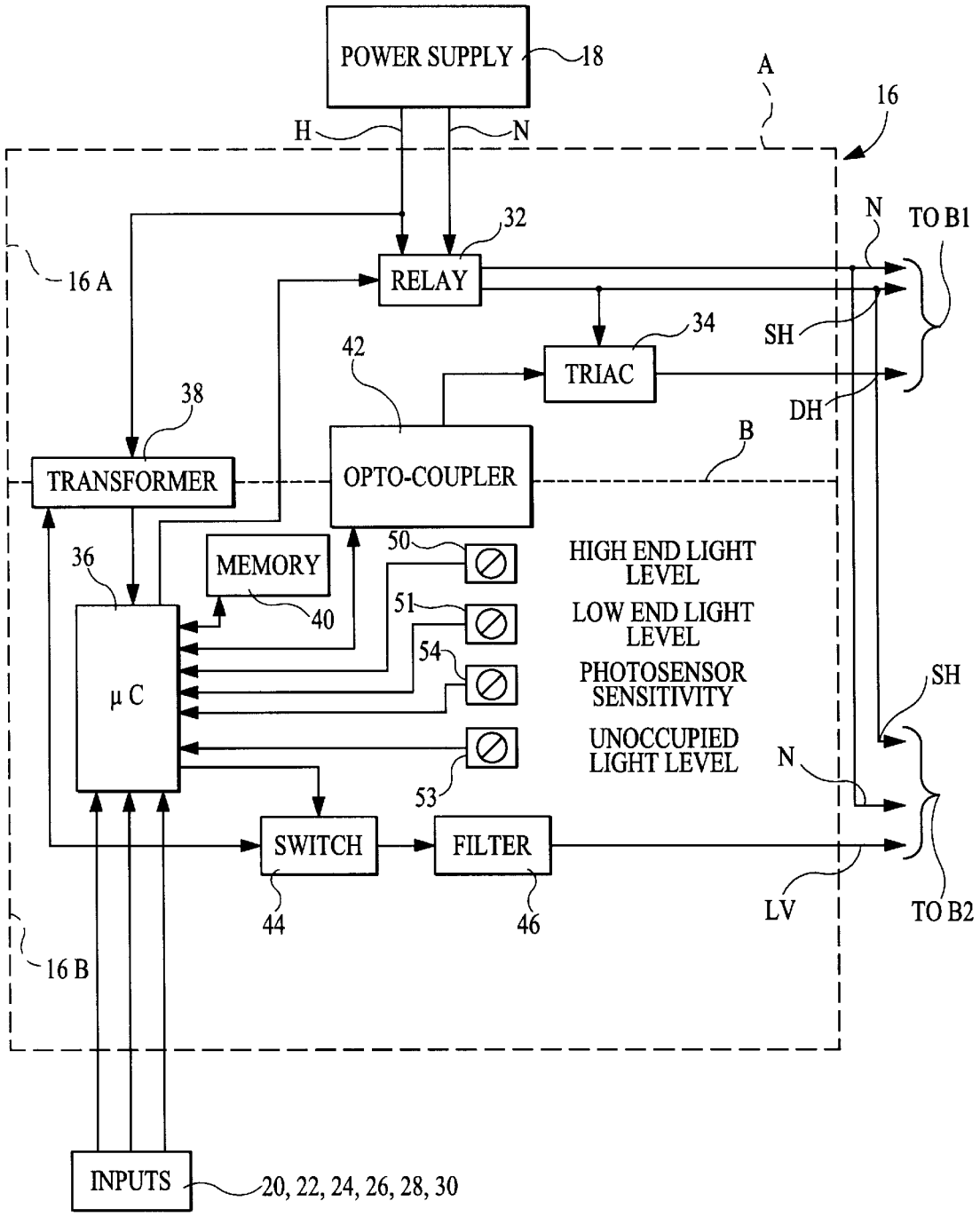
FIG. 2 (PRIOR ART)
FIG. 2 is an electrical block diagram illustrating various components of the prior art light controller shown in FIG. 1.

FIGS. 1 and 2 show a prior art lighting control system which can be modified, as later shown in FIG. 3 and 4 respectively.

Referring first to FIG. 1, the Figure schematically illustrates an energy-saving lighting control system 10 which controls the level of light provided by a pair of fluorescent lamp fixtures 12 and 14. Only two fixtures are shown, it being understood that a significantly larger number (e.g. as many as 50 two-lamp fixtures) can be controlled by the output of the system. The respective levels of lighting provided by lamp fixtures 12 and 14 are controlled by the respective outputs of fluorescent dimming ballasts B1 and B2 which operate under the control of a programmable lamp controller 16, described below. Two entirely different types of fluorescent dimming ballasts are indicated, B1 being of the type that adjusts lamp intensity or brightness based on signals carried on three high voltage wires (i.e., neutral, N; switched hot, SH; and dimmed hot, DH), and B2 being of the type that adjusts lamp intensity based on signals carried on two low voltage wires, common C and low voltage signal LV. Power is provided to the ballast B2 on high voltage wires (i.e., N and SH). The Hi-lume fluorescent lamp ballast, manufactured by Lutron Electronics Co., Inc., is exemplary of the B1 ballast, and the Mark VII fluorescent lamp ballast, manufactured by Advance Transformer Co., is exemplary of the B2 ballast. Typically, the high voltage hot wire SH carries a voltage between 100 and 277 volts AC, and the low voltage signal wire varies between 0 and 10 volts DC. The lighting control system can control any combination of both types of ballasts.

System 10 comprises a microcontroller-based lamp controller 16 which is adapted to receive power from an AC power source 18. The latter may have a voltage between 100 and 277 volts, and may be either 50 or 60 Hertz. The dimming ballast output of lamp controller 10 is determined by a plurality of input signals which are provided, for example, by a manual wall box control 20, an occupant sensor 22, a photosensor 24, a time clock 26, a fire/security sensor 28 and a load shed sensor 30. With the exceptions noted below, the input that requires the least energy consumption is the input that controls the lamp controller output. Input devices of the above type are well known. The manual wall box dimmer control comprises a movable actuator 21 (shown as a slider, but which could be a rotary member) whose physical position determines the impedance of a potentiometer which, in turn determines the output voltage (e.g. 0–20 volts) of the control. When the actuator is at one extreme of its allowed range of movement, the wall control requests zero light, and when it is at its other extreme, it requests high end light. The high end light level may be adjusted by means of trimming potentiometer (trim pot) 50, shown in FIG. 2. The high end light level trim pot 50, shown in FIG. 2, is typically adjusted so that even if the actuator is at its extreme position, the light output from the connected lamp is less than the maximum light output possible. The typical high end trim pot is set to about 60%–100% of the maximum light output. When below 100% the user will get an automatic energy savings.

The low end light level may be adjusted by means of a trimming potentiometer (trim pot) 51, shown in FIG. 2. When the low end trim pot is properly set, the lighting controller will operate the ballast to control the connected lamp at the ballasts designed low end light level. The low end light level of different manufacturer's ballast's ranges from about 1% to about 20%. A suitable wall control is disclosed, for example in the commonly assigned U.S. Pat. No. 4,742,188, issued on May 3, 1988.

Occupant sensor 22 may be of the conventional passive infrared variety which produces a fixed (i.e., constant amplitude) output signal upon sensing a change in ambient temperature on a pyroelectric sensor pair. Such a change is produced by the body heat of a person moving within the room containing the controlled lamps. Sensor 22 may also comprise a microwave or ultrasonic detection system which operates on the well-known Doppler effect to sense occupancy. Whatever the technology, the output of the occupant sensor is either high or low, indicating occupancy or no occupancy. When the area to be illuminated (which is usually referred to herein as a "room", but it will be understood that the area need not be bounded by walls) is occupied, the sensor output requests high end light level from the lighting controller. The lighting controller will combine this request with other input control device requests to set the proper amount of artificial light to be added to the room. Again, this high end light level is adjustable by the setting of trim pot 50. When the room is not occupied, the occupant sensor output requests an unoccupied light level which is adjustable by setting trimming potentiometer (trim pot) 53. This unoccupied light level may be "off", low end light level, or any higher light level up to approximately 40% of the maximum light level. The unoccupied light level is adjusted at trimming potentiometer 53 as shown in FIG. 2.

When the lighting controller receives a signal from a time clock input 26 that the lights are to be turned "off", the lighting controller signals the ballast to flash the connected lamp to maximum light level (to signal an occupant that the lights are about to go off) and then the controller signals the ballast to dim the connected lamp to low end light level for a predetermined time period (preferably 5 minutes). This is to eliminate the problem of turning the lights off in a room where someone is still working and leaving the person in complete darkness.

A fire/security input 28 provides an input to the lighting controller to signal the lighting controller that a fire/security condition exists and the lamps should be driven to high end light level until the fire/security condition is removed.

A load shed input 30 provides an input to the lighting controller to signal the lighting controller to reduce the amount of light output from the lamps by approximately 25%. The load shed input will not, however, reduce the light output below the low end light level. The load shed input is used to reduce the total amount power used by the system. The local utility company may request a facility owner to reduce power consumption on days of high demand or the facility owner may enable the load shed to reduce their peak demand.

Photosensor 24 merely comprises a light-responsive photosensitive element which is adapted to produce a low voltage signal in response to the level of light it receives. The gain of the photosensor can be adjusted using the trimming potentiometer 54 shown in FIG. 2. This is done to map the light received at the photosensor, commonly mounted on the ceiling, to the actual light available on the task area. Variations in reflectivity, color and layout of the space can be adjusted for with the photosensor gain.

Time clock 26, fire/security sensor 28, and load shed detector 30 are simply on/off switches that provide a high or low input to the lamp controller input to which they are attached.

Referring to FIG. 2, programmable lamp controller 16 is schematically illustrated as comprising a housing A having a barrier B which defines a high voltage section 16A, and a low voltage section 16B. The high voltage section is adapted to receive line voltage signals from the AC power supply 18. It contains a relay 32 through which AC power is selectively applied to the lamp ballasts, and a controllably conductive device, shown as a triac 34, through which a dimmed hot signal DH is supplied to the B1 ballasts. The triac 34 operates under the control of a microcontroller 36 through opto-coupler 42 which controls the overall operation of the lamp controller. Low voltage (e.g. 5 volts) power is supplied to the microcontroller via a switch mode power supply which includes a Class 2 transformer 38. The microcontroller comprises a memory 40 which is suitably programmed to provide the desired operating features. A preferred microcontroller for controller 16 is the Model ST62T10, made by SGS Thompson Microelectronics Co. which is capable of accepting both analog and digital inputs. Microcontroller 36 operates to control the firing of triac 34 through a conventional opto-coupler 42. The microcontroller 36 also operates to provide pulse-width modulation control of controllably conductive device 44, preferably via another optocoupler, not shown, which, through a smoothing filter 46, provides a suitable low voltage control signal LV by which dimming ballast B2 is controlled. As illustrated, the microcontroller is adapted to receive at least six different input signals, some of a digital nature (e.g., inputs 22, 26, 28 and 30), and others being of an analog nature (e.g., inputs 20 and 24).

The energy-saving lighting control system described above is programmed to provide several features. First, whenever the actuator 21 of wall control 20 is moved, the controller's output (which is normally controlled by the input requiring the least energy) is overridden for a predetermined time, and the lighting level is determined by the position of the actuator, independent of the state of the time clock 26 or occupant sensor 22. Thus, even "after hours" when the time clock input is requesting that the lights be turned off, or when an occupant sensor is used and no occupant is sensed, movement of the wall control actuator will temporarily override the time clock and/or occupant sensor input and cause the lights to be turned on to the level indicated by the actuator position. Movement of the actuator can readily be determined by monitoring the state of the potentiometer to which the actuator is connected. This can be accomplished by comparing the voltage provided on the signal lead of the potentiometer with its value at some previous time, and by indicating movement when the two values differ by more than some preset value. Alternatively, actuator movement could be detected by the technique disclosed in the commonly assigned U.S. Pat. No. 4,987,372, issued on Jan. 22, 1991 to J. Ofori-Tenkorang, entitled "Potentiometer State Sensing Circuit", the disclosure of which is incorporated herein by reference. Preferably, the duration of the override period during normal or working hours is 60 seconds, after which the system returns to its normal mode of operation. This period is usually sufficient to allow security personnel, for example, to turn the room lights on momentarily without having to be concerned with changing the state of a time clock and/or occupant sensor input.

A second feature of the lighting control system of FIG. 2, is that whenever any one of the trim pots 50, 51, 53 and 54 is adjusted, the system automatically switches from its normal operating mode to an off-normal or "calibration" mode. Here again, movement of the pots can be detected by detecting variations in voltage, as mentioned above, or by the scheme disclosed in the aforementioned U.S. Pat. No. 4,987,372. In a calibration mode, the microcontroller ignores any and all of its pre-programmed fade rates (i.e. the rate at which one input produces a change in lighting level). These fade rates normally cause the light level to change very slowly in response to changes in the switch inputs so that the user is not subjected to abrupt and unpleasant lighting changes. However, during calibration, these slow variations are undesirable as the calibration process becomes time consuming, and it is difficult to achieve proper settings. By ignoring the normal fade rates during calibration, the person doing the calibration receives immediate lighting level feedback as the trim pot is adjusted. Also, by automatically switching to a calibration mode in response to adjustment of the trim pots, the present lighting levels can be changed without having to activate a separate calibration switch which may not always be deactivated following recalibration, and without having to manually set various input devices to specific states to allow adjustment of their respective effects. The microcontroller is programmed to return to the normal operating mode within a very short time (e.g. 60 seconds) following the completion of the most recent trim pot adjustment.

A third feature of the lighting control system of FIG. 2 is that it allows all inputs to be overridden in response to a "panic" call, such as produced by a closure of the fire/security input 28.

A fourth feature of the system of FIG. 2 is that the microcontroller has multiple outputs that are adapted to control entirely different types of fluorescent ballasts and dimming circuits. As noted earlier, the microcontroller outputs control switches 34 and 44 which, in turn, provide different control signals to the different ballasts.

Still another feature of the lighting control system of FIG. 2 is that it is adapted to be operated from different power sources, those most common in different countries of the world.

In accordance with the present invention, all dimming functions of the system of FIGS. 1 and 2 are disabled for a given time, preferably about 100 hours, to season, or burn-in new fluorescent lamps in fixtures 12 and 14 to drive them preferably with an uninterrupted, full rated current before they can be operated in a manual or automatic dimming mode.

Figure 3:
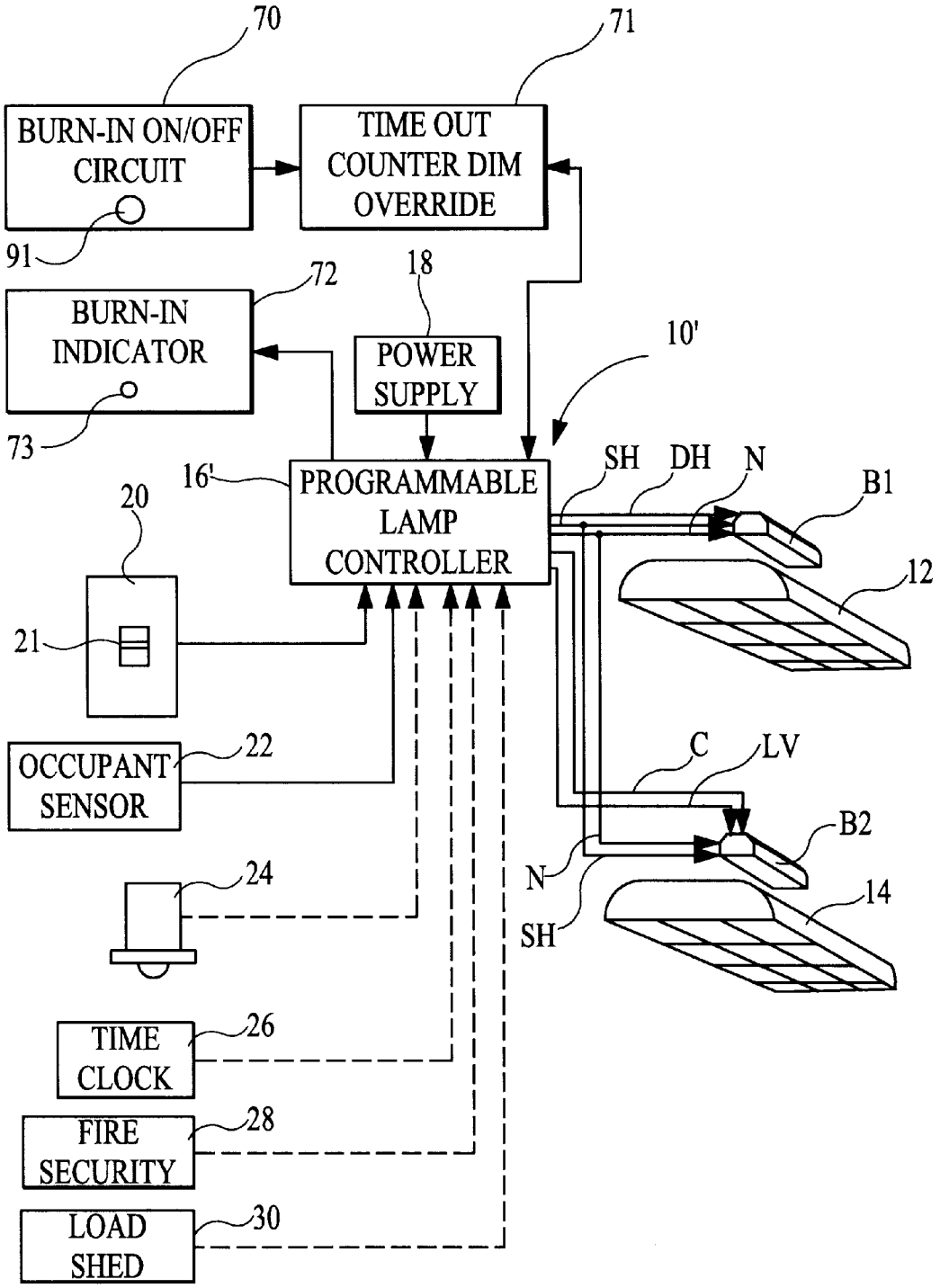
FIG. 3 shows the schematic illustration of FIG. 1 modified to incorporate the improvement of the invention.
Figure 4:
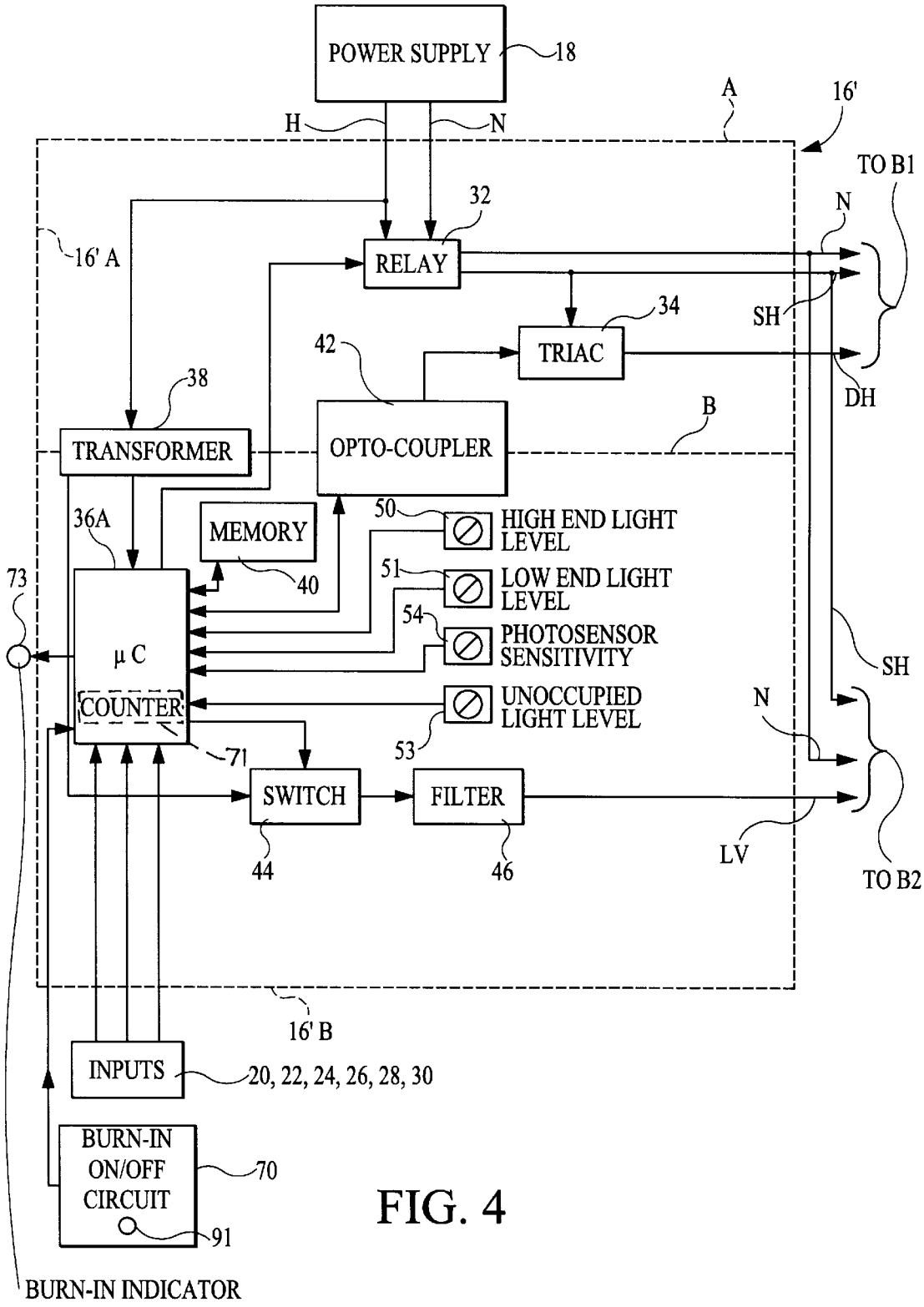
FIG. 4 shows the block diagram of FIG. 2 modified to incorporate the improvement of the invention.

FIGS. 3 and 4 show the novel invention superimposed on the prior art schematic and block diagram of FIGS. 1 and 2 respectively. Similar numerals identifies similar components.

Referring first to FIG. 3, it will be seen that a burn-in ON/OFF circuit 70 is added as an exterior control. The burn-in on/off circuit 70 can be initiated by an actuator 91 which activates preferably momentary-on switch 97 (see FIG. 6, described below). The circuit 70 is coupled to a time-out counter 71 (which may be integrated into controller 36A, See FIG. 4) and for the time period determined by the time-out counter, ignores dimming requests from control 20 (except for requests to completely turn off the lamp) and further ignores inputs 22, 24, 26, 28 or 30 for the given time, preferably about 100 hours, although other times can be used if desired. The inventor of the present invention has determined that the end user may wish to temporarily terminate the burn-in process without resetting the count down timer, i.e., turn off the lamps. To terminate the burn-in process without resetting the count down timer, the end user simply turns the wall control 20 off. During the burn-in process, the wall control 20 operates as an on/off switch (i.e., no dimming). While the time-out interval is running, the output current to ballasts B1 and B2 is preferably full current, although some reduced current may be used. Further, it may be possible to operate the lamps at slightly varying current over a 24 hour period so long as seasoning or burn-in continues, preferably without any complete interruption.

It is possible that personnel who are unaware that a burn-in function is proceeding will believe that the dimming function of the system has failed. For this reason, a burn-in function indicator circuit 72 is provided in which an indicator 73, which may be a light emitting diode, LED, is illuminated by signals controlled by the microcontroller 36A (See FIG. 4) to provide a visible indication that the burn-in function is in use. Indicator lamp 73 can be located where convenient, for example, at the housing of controller 16 or at the manual control location with control 20 or both.

FIG. 4 shows the burn-in ON/OFF circuit 70 and indicator lamp 73 coupled to microcontroller 36A. The time-out counter 71 is incorporated into the appropriately modified microcontroller 36A in FIG. 4.

Figure 5A:
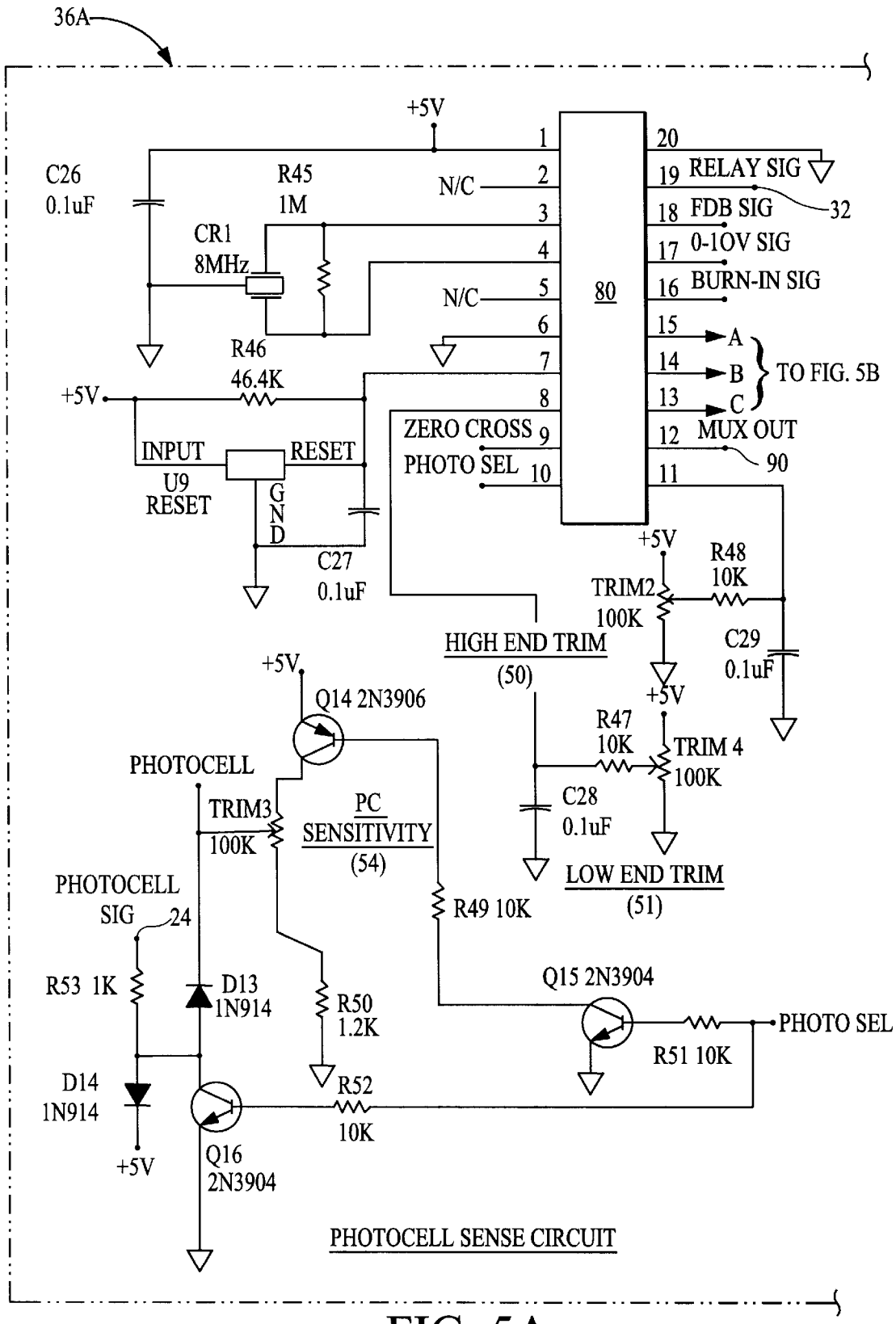
FIGS. 5A, 5B and 5C shows the microcontroller of FIGS. 3 and 4 which contains the time-out counter and dimming override function of the present invention.
Figure 5B:
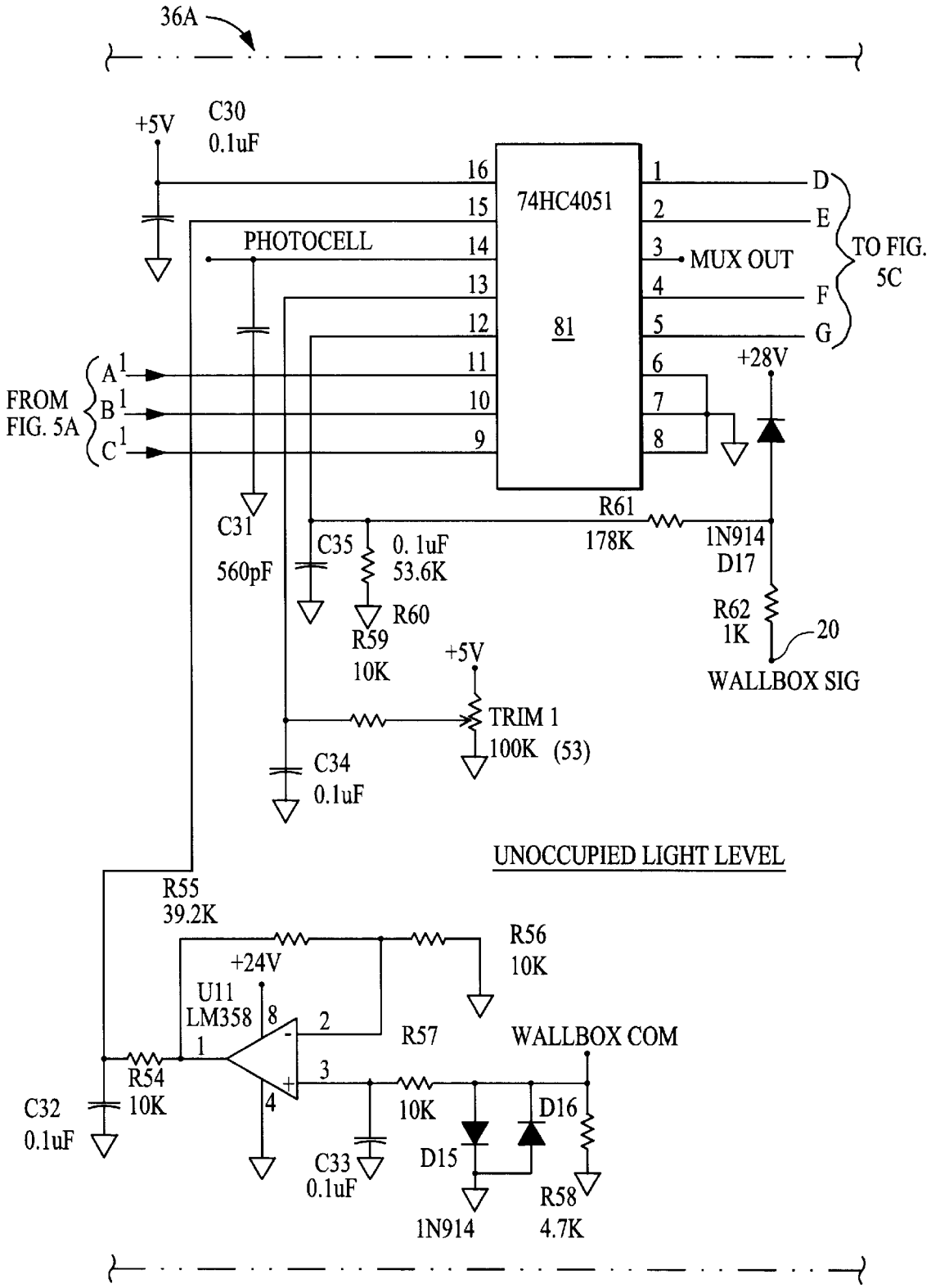
Figure 5C:
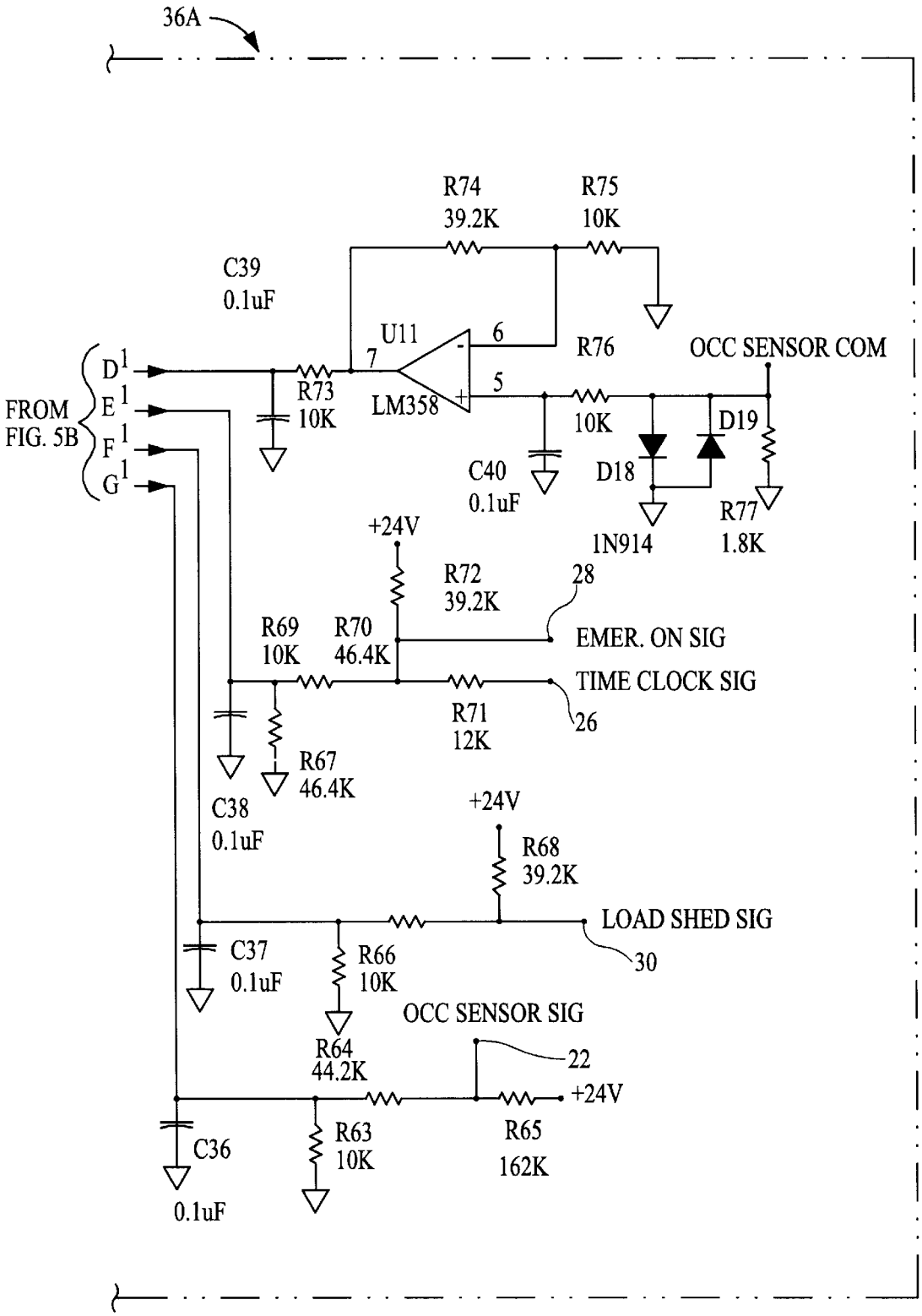

FIGS. 5A, 5B and 5C are a circuit diagram of controller 36A of FIG. 4 and contains a microcontroller 80 which may be type ST62T10B6 manufactured by SGS Thomson and a multiplexer (MUX) chip 81 which may be a 74HC4051 manufactured by SGS Thomson. The chips 80 and 81 are controlled by the circuits which are shown and labeled in FIGS. 5A, 5B and 5C and include the functions labeled in FIGS. 3 and 4 of:

High End Trim 50;

Low End Trim 51;

Unoccupied Light Level Trim 53;

Photosensor Sensitivity 54;

Photo Cell Signal 24;

Occupancy Sensor Signal 22;

Wallbox Signal 20;

Emergency on Signal 28;

Time Clock Signal 26;

Load Shed Signal 30;

Relay Output Signal 32.

The burn-in signal (which is produced by the circuit of FIG. 6) is applied to Pin 16 of microcontroller 80, and controls the counter contained within microcontroller 80.

Figure 6:
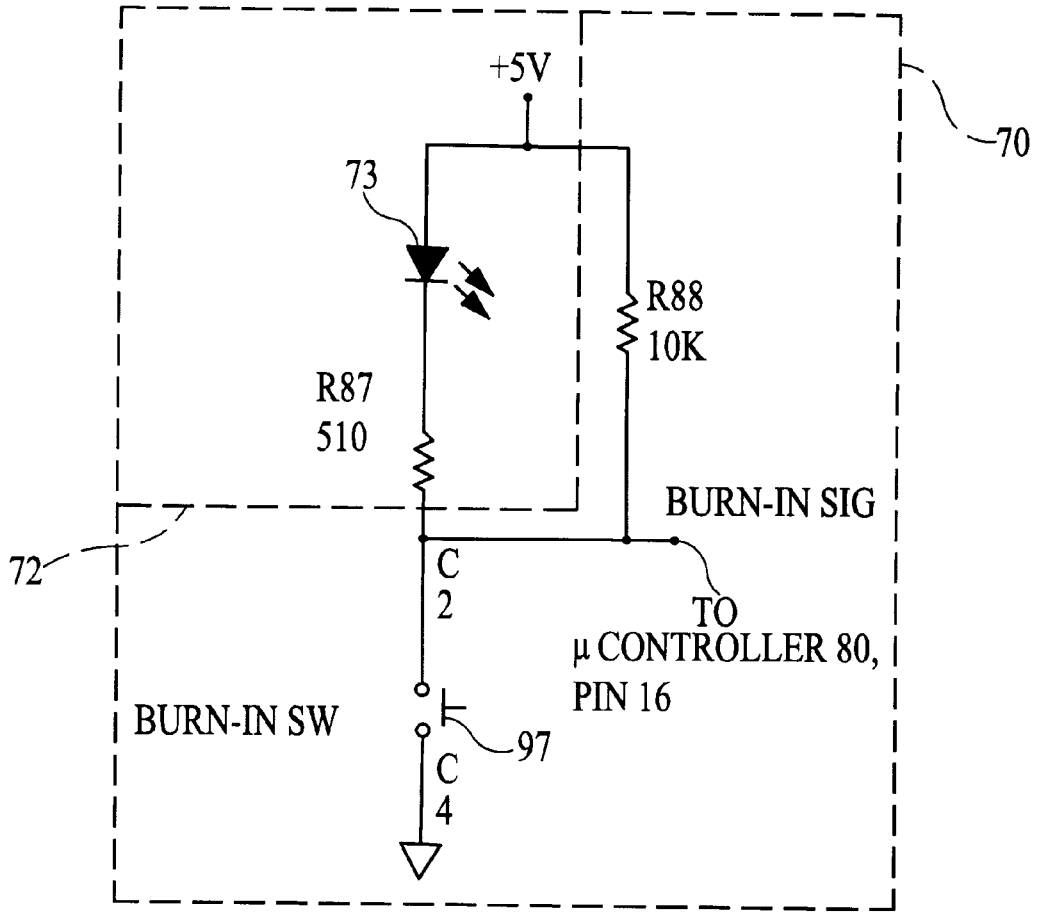
FIG. 6 shows a detailed circuit diagram of the preferred burn-in control circuit and indicator of the present invention.

Referring next to FIG. 6, there is shown a preferred burn-in on/off circuit 70 and burn-in function indicator circuit 72 which includes indicator 73. Burn-in switch 97 (FIG. 6) can be momentarily closed using actuator 91 (FIG. 3 and FIG. 4) to signal pin 16 of microcontroller 80 to start the burn-in process. Pin 16 is used as an input and as an output. The microcontroller uses pin 16 as an input to determine if switch 97 has been closed. The microcontroller uses pin 16 as an output to drive the indicator 73 when necessary. Pin 16 is used as an output a majority of the time. During the burn-in process, all dimming functions of microcontroller 80 are disabled. Note that the burn-in can be manually discontinued by reoperating switch 97. Further, indicator 73 is illuminated to display that the burn-in function is on. Once the time-out is completed, the series circuit comprising indicator 73 and series resistor R87 is opened by microcontroller 80 to restore all dimming functions.

Burn-in actuator 91 and switch 97 can be eliminated and an input signal to start the burn-in process can be received directly into the microcontroller from an external signal source. The input signal can be a digital signal from a building management system for example.

Figure 7:
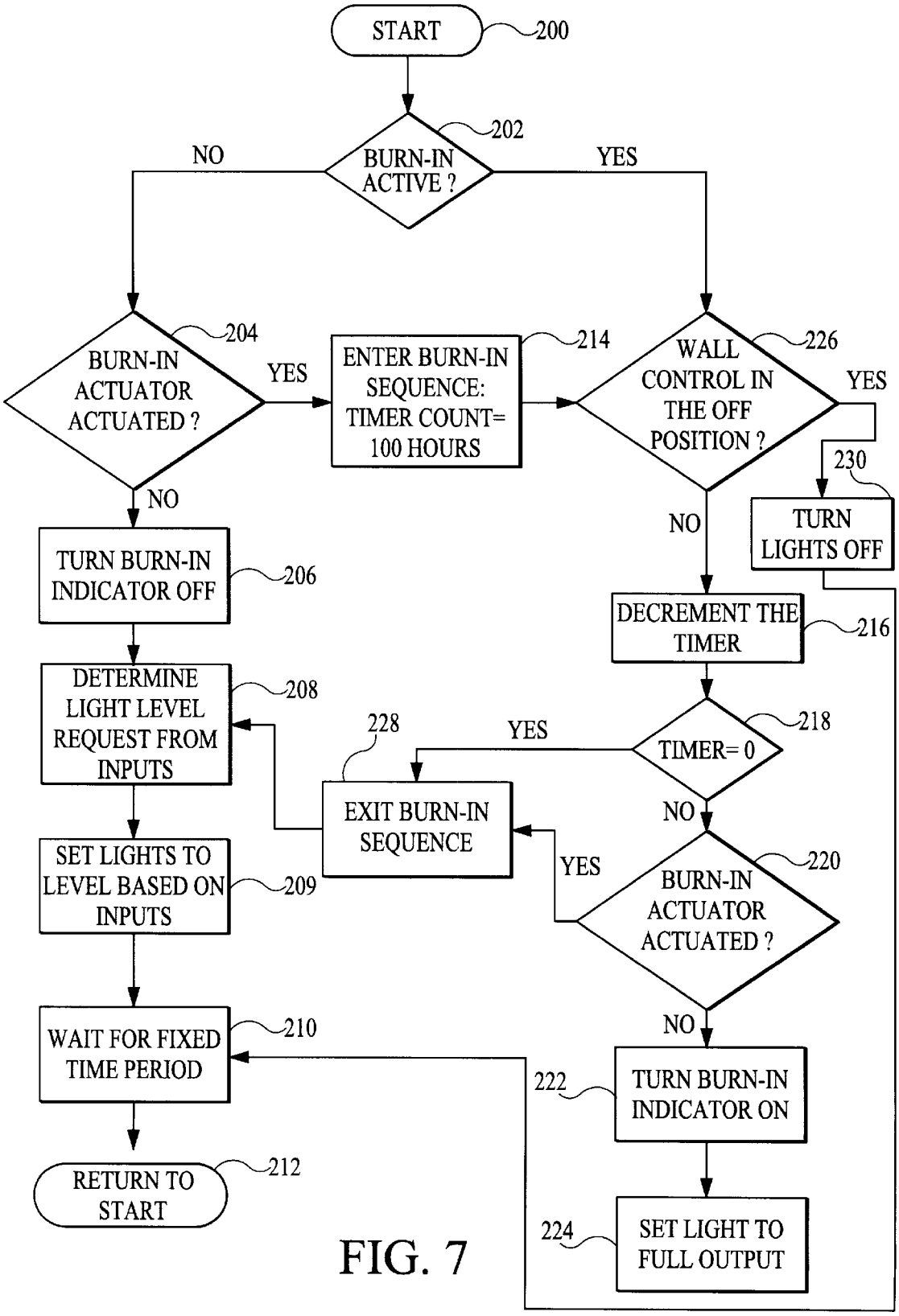
FIG. 7 is a flow chart which illustrates the operation of the burn-in circuit (or seasoning circuit) of the invention.

FIG. 7 is a flow chart which illustrates the operation of the present invention shown in FIGS. 3–6. The operation of the lighting controller/system starts at step 200 and proceeds to a step 202 where the microcontroller determines if "the burn-in" is active. If the system burn-in is not active, the microcontroller continues to a step 204 and determines if "the burn-in actuator 91" has been actuated. If the burn-in actuator 91 has not been actuated, the microcontroller continues to step 206. At step 206 the microcontroller "turns the burn-in indicator 73 off" and proceeds to step 208. At step 208 the microcontroller determines the light level requests from the inputs 20, 22, 24, 26, 28, and 30. The microcontroller then proceeds to step 209 where the microcontroller sets the light output to a level based on the inputs. The microcontroller then waits a fixed period of time at step 210. This is to ensure that each time the microcontroller makes one loop through the program the same amount of time elapses. Otherwise the count down timer (explained below) could not properly keep track of the elapsed time. The microcontroller then returns to start at step 212. During normal operation the system will follow this path repeatedly.

If at step 204 the microcontroller determines that the burn-in actuator 91 has been actuated, the microcontroller continues to step 214. At step 214 the microcontroller enters the burn-in process and sets the count-down timer to 100 hours and continues to step 226. At step 226 the microcontroller determines if the "wall control is in the off position". The burn-in process will not start unless a wall control is in the "on" position. This gives the end user the ability to turn the lights "off" without resetting the timer. If the microcontroller determines that the wall control is "off", the microcontroller proceeds to step 230, turns the lights off and continues to step 210.

If at step 202 the microcontroller determines that the "burn-in is active" the microcontroller proceeds to step 226.

If at step 226 the microcontroller determines that the wall control is not "off", the microcontroller continues to step 216 where the timer is decremented and the microcontroller then proceeds to step 218. At step 218 the microcontroller determines if the count down timer has reached zero. If the count down timer has reached zero, the burn-in process is exited at step 228 and the microcontroller continues to step 208.

If at step 218 the microcontroller determines that the count down timer has not reached zero, i.e., the burn-in process has not been completed, the microcontroller proceeds to step 220. At step 220 the microcontroller determines if the "burn-in actuator has been actuated". If the microcontroller determines that the burn-in actuator has been actuated, the microcontroller proceeds to step 228. This path occurs only if the system is in the burn-in process and the end user wants to stop the process and reset the timer.

If at step 220 the microcontroller determines that the burn-in actuator has not been actuated, the microcontroller continues to step 222. At step 222 the microcontroller "turns the burn-in indicator 73 on" and proceeds to step 224. At step 224 the microcontroller sets the light output of the lamps to full and proceeds to step 210. The microcontroller follows the paths 202, 226, 216, 218, 220, 222, 224, 210, 212 and back to 202 during the time the lamps are being burned in.

Once the seasoning process is initiated and it is to be turned off for any reason, momentary switch 97 is actuated. Microcontroller 80 interrogates the system for the actuation of switch 97 and, if it is reactuated, the microcontroller exits the burn-in process, resets the system for dimming operation and turns off indicator 73. If however, no turn off signal is sensed, the timer is decremented until it times out, and the burn-in process is terminated, and the dimming functions are then restored. If the burn-in process is then reentered by actuating switch 97, the time-out counter is reset. The invention could also be modified to account for the amount of burn-in time already used. It should be noted that the invention allows the user to temporarily override the burn-in process by using the switch 20, at least to allow the lamps to be turned off. This use of switch 20 to turn off the lamps during burn-in does not reset the burn-in timer function.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A fluorescent lighting controller for controlling the light output of at least one fluorescent lamp, comprising:

a lamp control circuit for varying the light output of the lamp, a lamp seasoning control for seasoning the lamp by causing the lamp control circuit to drive the lamp with a predetermined electrical input power for a predetermined period of time, the lamp seasoning control including a timer determining the predetermined period of time, and an enabling circuit for selectively enabling the timer; further wherein the predetermined period of time comprises a predetermined lamp operational time, such that once the predetermined lamp operational time has been reached, the lamp seasoning control is disabled from causing the lamp control circuit to drive the lamp with the predetermined electrical input power.

2. The lighting controller of claim 1, wherein the predetermined period of time is about 100 hours.

3. The lighting controller of claim 1 wherein the predetermined electrical input power comprises the rated voltage across the lamp times its rated current.

4. The lighting controller of claim 1 wherein said predetermined electrical input power is a power required to produce a rated output light intensity of the lamp.

5. The lighting controller of claim 1 wherein the lamp control circuit includes input terminals which receive input signals to cause responsive dimming of said lamp and the lamp seasoning control includes a time-out function to selectively disable a dimming function of the lamp control circuit during a timing operation of said time-out function; and a manually operable switch for initiating the timing operation of said time-out function.

6. The lighting controller of claim 5, wherein the manually operable switch allows the timing operation to be interrupted to enable the dimming function to be restored prior to timing-out of said timing operation.

7. The lighting controller of claim 6, wherein the timing operation is reset when said manually operable switch is actuated.

8. The lighting controller of claim 1, wherein the lamp control circuit is adapted to be controlled by a control switch coupled to the controller for controlling an on/off function of the lamp, and wherein the lamp control circuit includes provision for allowing the on/off function to be operated prior to the end of the predetermined period of time without resetting the predetermined period of time.

9. A fluorescent lighting controller for controlling the light output of at least one fluorescent lamp, comprising:

a control circuit for selectively seasoning the at least one lamp by operating the lamp at a predetermined intensity for a predetermined period of time, and a burn-in input terminal coupled to the control circuit for receiving a signal to selectively initiate the seasoning; further wherein the predetermined period of time comprises a predetermined lamp operational time, such that once the predetermined lamp operational time has been reached, the control circuit is prevented from receiving the signal to initiate seasoning the at least one lamp at the predetermined intensity.

10. The lighting controller of claim 9, wherein the predetermined period of time is about 100 hours.

11. The controller of claim 9 wherein said predetermined period of time is a continuous and uninterrupted time period.

12. The lighting controller of claim 9 wherein the controller includes input terminals which receive input signals to cause responsive dimming of said lamp and a time-out function operating to control said controller to selectively disable a dimming function of the controller during a timing operation of said time-out function; and a manually operable switch for initiating the timing operation of said time-out function.

13. The lighting controller of claim 12, wherein the manually operable switch allows the timing operation to be interrupted to enable the dimming function to be restored prior to timing-out of said timing operation.

14. The lighting controller of claim 12, wherein the timing operation is reset when said manually operable switch is actuated.

15. The lighting controller of claim 9, wherein the controller is adapted to be controlled by a control switch coupled to the controller for controlling an on/off function of the lamp, and wherein the controller includes provision for allowing the on/off function to be operated prior to the end of the predetermined period of time without resetting the predetermined period of time.

16. A process for operating a fluorescent lamp dimmer system comprising the steps of:

driving a lamp initially at a requested light level;

receiving a lamp seasoning initiation signal, initiating a timer in response to the lamp seasoning initiation signal, blocking a response by the lamp to at least some input control signals to said dimmer system for a predetermined period of time determined by said timer and driving the lamp at a predetermined power level until the lamp is seasoned, and thereafter driving the lamp at a requested light level based on the input control signals after the predetermined period of time has ended; further wherein the predetermined period of time comprises a predetermined lamp operational time, further comprising stopping driving the lamp at the predetermined power level once the predetermined lamp operational time has been reached.

17. The process of claim 16, wherein the predetermined period of time is about 100 hours.

18. The process of claim 16 wherein the predetermined power level comprises the rated voltage across the lamp times its rated current.

19. The process of claim 16 wherein said predetermined power level is the power required to produce a rated output light intensity of the lamp.

20. The process of claim 16, further including providing a controller having input terminals which receive input signals to cause responsive dimming of said lamp and a time-out function to selectively disable a dimming function of the controller during said predetermined period of time; and providing a manually operable switch for initiating the timer.

21. The process of claim 16 wherein said predetermined period of time is a continuous and uninterrupted period.

22. The process of claim 21, wherein the predetermined period of time is about 100 hours.

23. The process of claim 16, further comprising interrupting the predetermined period of time to enable the dimming function to be restored prior to timing-out of said predetermined period of time.

24. The process of claim 16, wherein the predetermined period of time is about 100 hours.

25. The process of claim 16, further comprising providing a switch for controlling the on/off function of the lamp, and further comprising allowing the on/off function to be operated prior to the end of the predetermined period of time without resetting the predetermined period of time.

26. The process of claim 16, wherein the input control signals that are blocked during the predetermined period of time comprise all control signals implementing a dimming function of the dimmer system.

27. A fluorescent lighting controller for controlling the light output of at least one fluorescent lamp, comprising:

a lamp control circuit for varying the light output of the lamp, a lamp seasoning control for seasoning the lamp by causing the lamp control circuit to drive the lamp with a predetermined electrical input power for a predetermined period of time, and a memory for storing a representation of the cumulative seasoning time of the lamp, said memory operatively coupled to said lamp seasoning control so as to provide an indication as to when said predetermined period of time has elapsed.

28. The fluorescent lighting controller of claim 27, wherein the predetermined period of time is about 100 hours.

29. The fluorescent lighting controller of claim 27 wherein the predetermined electrical input power comprises the rated voltage across the lamp times its rated current.

30. The fluorescent lighting controller of claim 27 wherein said predetermined electrical input power is a power required to produce a rated output light intensity of the lamp.

31. The fluorescent lighting controller of claim 27 wherein the lamp control circuit includes input terminals which receive input signals to cause responsive dimming of said lamp and the lamp seasoning control includes a time-out function to selectively disable a dimming function of the lamp control circuit during a timing operation of said time-out function; and a manually operable switch for initiating the timing operation of said time-out function.

32. A fluorescent lighting controller for controlling the light output of at least one fluorescent lamp, comprising:

a lamp control circuit for varying the light output of the lamp, the lamp having at least one lamp filament;

a lamp seasoning control for seasoning the lamp by causing the lamp control circuit to drive the lamp with a predetermined electrical input power for a predetermined period of time, the lamp seasoning control including a timer determining the predetermined period of time, and an enabling circuit for selectively enabling the timer; further wherein the predetermined period of time comprises a predetermined lamp operational time sufficient to permanently drive lamp impurities away from the at least one lamp filament.

33. A fluorescent lighting controller for controlling the light output of at least one fluorescent lamp, comprising:

a lamp control circuit for varying the light output of the lamp, the lamp having a phosphor coating;

a lamp seasoning control for seasoning the lamp by causing the lamp control circuit to drive the lamp with a predetermined electrical input power for a predetermined period of time, the lamp seasoning control including a timer determining the predetermined period of time, and an enabling circuit for selectively enabling the timer, further wherein the predetermined time comprises a predetermined lamp operational time sufficient to drive lamp impurities into the lamp phosphor coating.

* * * * *